US011495419B2

(12) United States Patent
Fujimoto et al.

(10) Patent No.: US 11,495,419 B2
(45) Date of Patent: Nov. 8, 2022

(54) SWITCH DEVICE

(71) Applicant: KABUSHIKI KAISHA TOKAI RIKA DENKI SEISAKUSHO, Aichi (JP)

(72) Inventors: Takeshi Fujimoto, Aichi (JP); Masaya Murota, Aichi (JP); Takaho Kobayashi, Aichi (JP)

(73) Assignee: KABUSHIKI KAISHA TOKAI RIKA DENKI SEISAKUSHO, Aichi (JP)

( * ) Notice: Subject to any disclaimer, the term of this patent is extended or adjusted under 35 U.S.C. 154(b) by 0 days.

(21) Appl. No.: 17/229,369

(22) Filed: Apr. 13, 2021

(65) Prior Publication Data

US 2021/0327659 A1 Oct. 21, 2021

(30) Foreign Application Priority Data

Apr. 17, 2020 (JP) ..... JP2020-074058

(51) Int. Cl.
*H01H 13/14* (2006.01)
*H01H 13/36* (2006.01)

(52) U.S. Cl.
CPC ..... *H01H 13/14* (2013.01); *H01H 13/365* (2013.01)

(58) Field of Classification Search
CPC .... H01H 13/14; H01H 13/365; H01H 1/5805; H01H 23/08; H01H 2001/5888; H01H 5/22; H01H 23/20; H01H 13/22; H01H 13/26; H01H 13/36; H01H 13/40; H01H 5/00; H01H 5/04; H01H 5/18
See application file for complete search history.

(56) References Cited

U.S. PATENT DOCUMENTS 5,717,177 A * 2/1998 Tsai ..... H01H 13/36 200/16 R
8,383,975 B2 * 2/2013 Lin ..... H01H 13/36 200/409
8,440,927 B2 * 5/2013 Lin ..... H01H 13/36 200/408
2007/0267284 A1 * 11/2007 Cheng-Tsai ..... H01H 13/10 200/402
2015/0114812 A1 * 4/2015 Mantua ..... H01H 5/28 200/468

FOREIGN PATENT DOCUMENTS

JP 2004142522 A 5/2004

* cited by examiner

*Primary Examiner* — Lheiren Mae A Caroc

(74) *Attorney, Agent, or Firm* — Tarolli, Sundheim, Covell & Tummino LLP

(57) ABSTRACT

A switch device includes two fixed contacts and a movable contact of which position is changed when an operation unit is operated to selectively contact the fixed contacts. The switch device also includes a snap action mechanism that switches a contact state of the movable contact with the fixed contacts by deforming a spring portion in accordance with an operation amount of the operation unit. The switch device also includes a control unit that determines an operation state of the operation unit based on a detection signal received from the fixed contacts and the movable contact.

8 Claims, 4 Drawing Sheets

| | | P1 | P2 | P3 | P4 |
|---|---|---|---|---|---|
| Positions of Operation Unit | First Operation Position | ○ | ○ | ○ | |
| | Initial Position | ○ | ○ | ○ | ○ |
| | Second Operation Position | ○ | | ○ | ○ |

SWITCH DEVICE

CROSS-REFERENCE TO RELATED APPLICATIONS

This application is based upon and claims the benefit of priority from prior Japanese Patent Application No. 2020-074058, filed on Apr. 17, 2020, the entire contents of which are incorporated herein by reference.

BACKGROUND

Field

The present disclosure relates to a switch device operated to switch an activation state of a parking brake for a vehicle.

Description of Related Art

A switch device operated to switch an operated subject, such as an electric parking brake for a vehicle, between activated and deactivated states is known in the art. Japanese Laid-Open Patent Publication No. 2004-142522 describes a switch device including an operation unit that is tilted toward an activation side and a deactivation side, a contact unit of which a contact state is switched by the operation unit, and a control unit that controls an electric parking brake in accordance with the contact state.

The contact unit includes two contacts that are arranged in contact with the operation unit or separated from the operation unit when the operation unit is operated. Before the operation unit is operated, one of the two contacts is separated from the operation unit and the other one of the two contacts is in contact with the operation unit. The contact states of the two contacts are reversed from before and after the operation. The control unit detects the operation of the operation unit from the combination of the contact states of the contacts. The control unit also detects faults such as a contact failure and wire breakage.

The movement speed of the operation unit of the above switch device is determined by how a user operates the operation unit. Thus, when operating the operation unit, if the user keeps holding the operation unit, for example, at an intermediate position, the two contacts will both continue to be in contact with or separated from the operation unit. In such a case, the control unit may erroneously detect the occurrence of a fault.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a switch device operated to switch an activation state of a parking brake for a vehicle. The switch device includes at least two fixed contacts, a movable contact of which the position is changed when an operation unit is operated to selectively contact the at least two fixed contacts, a snap action mechanism that switches a contact state of the movable contact with the fixed contacts by deforming a spring portion in accordance with an operation amount of the operation unit, and a control unit that determines an operation state of the operation unit based on a detection signal received from the fixed contacts and the movable contact.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

A switch device 1 according to one embodiment will now be described with reference to the drawings.

Figure 1:
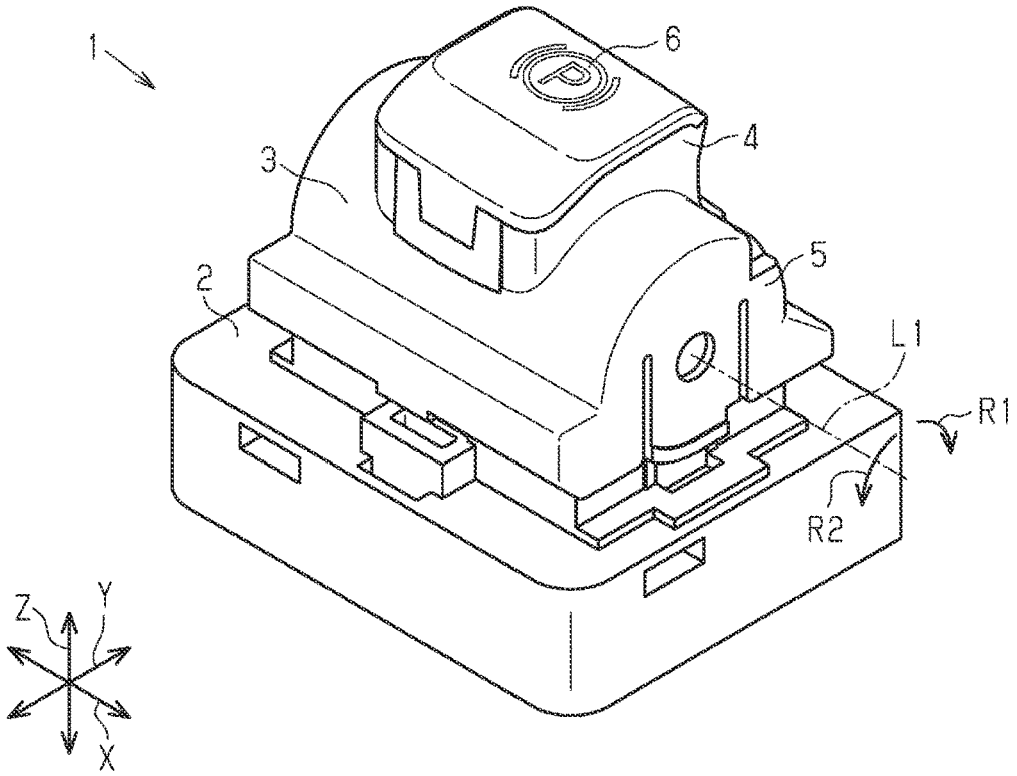
FIG. 1 is a perspective view showing a switch device.

As shown in FIG. 1, the switch device 1 includes a frame 2 and an operation unit 3 attached to the frame 2. The switch device 1 is arranged, for example, in the passenger compartment of a vehicle to activate and deactivate an electric parking brake. The switch device 1 is box-shaped and has a width, a length, and a height. In the drawings, an X-axis direction, a Y-axis direction, and a Z-axis direction respectively indicate a device width direction, a device length direction, and a device height direction. The frame 2 and the operation unit 3 are opposed toward each other in the device height direction. In the following description, the operation unit 3 is arranged at an upper side and the frame 2 is arranged at a lower side with respect to the device height direction of the switch device 1.

The operation unit 3 is supported by the frame 2 pivotally about an axis L1 extending in the device width direction. The operation unit 3 is tilted about the axis L1 in one direction and an opposite direction that will hereafter be referred to as the first operation direction R1 and the second operation direction R2, respectively. The operation unit 3 is tilted by lowering or raising one side of the operation unit 3 in the device length direction.

The operation unit 3 in accordance with the present embodiment is arranged at operation positions including an initial position where the operation unit 3 is located before being operated, a first operation position where the operation unit 3 is located after being operated from the initial position by a predetermined operation amount in the first operation direction R1, and a second operation position where the operation unit 3 is located after being operated from the initial position by a predetermined operation amount in the second operation direction R2. The operation unit 3 is held at the initial position by an urging member (not shown). That is, the operation unit 3 is of a momentary type in which the operation unit 3 returns to the initial position when a user releases the operation unit 3.

The operation unit 3 includes an upper end 4 operated by the user and a base 5 engaged with the frame 2. The upper end 4 includes a display 6 that displays the activation state of an electric parking brake to the user. The operation unit 3 is coupled to a vehicle body so that the base 5 is covered by a cover (not shown) from above and the upper end 4 is exposed from the cover.

Figure 2:
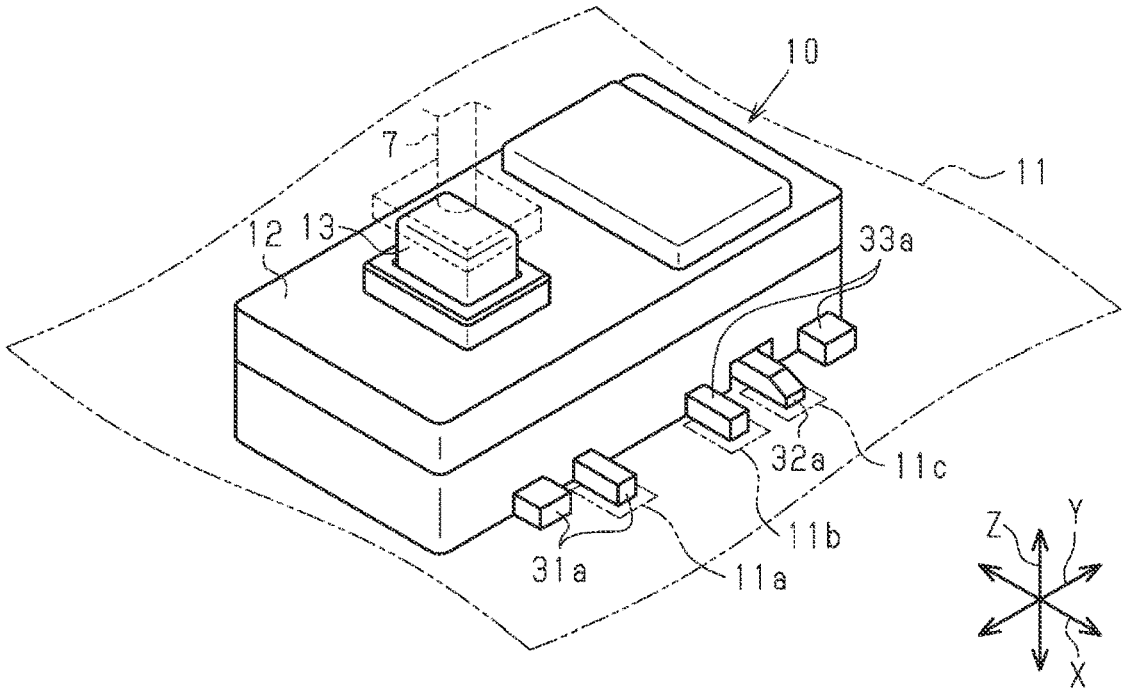
FIG. 2 is a perspective view showing a contact unit arranged in the switch device.

As shown in FIG. 2, the switch device 1 includes a contact unit 10 and a board 11. The operation unit 3 is operated to switch a contact state of the contact unit 10. The board 11 includes an upper mounting surface on which an electric circuit is formed. The contact unit 10 is arranged on the board 11. The contact unit 10 includes a case 12 that forms a shell and a push unit 13 that is movable into and out of the case 12.

A pusher 7 that moves in cooperation with the tilting of the operation unit 3 is arranged between the operation unit 3 and the contact unit 10. The pusher 7 is held so as to be movable upward and downward relative to, for example, the frame 2. The operation unit 3 is tilted to move the pusher 7 downward, which, in turn, pushes the push unit 13 downward. Preferably, the pusher 7 is arranged at an upper position when the operation unit 3 is not operated, that is, when the operation unit 3 is located at the initial position before being operated. The pusher 7 is urged upward by, for example, an elastic member (not shown).

Figure 3:
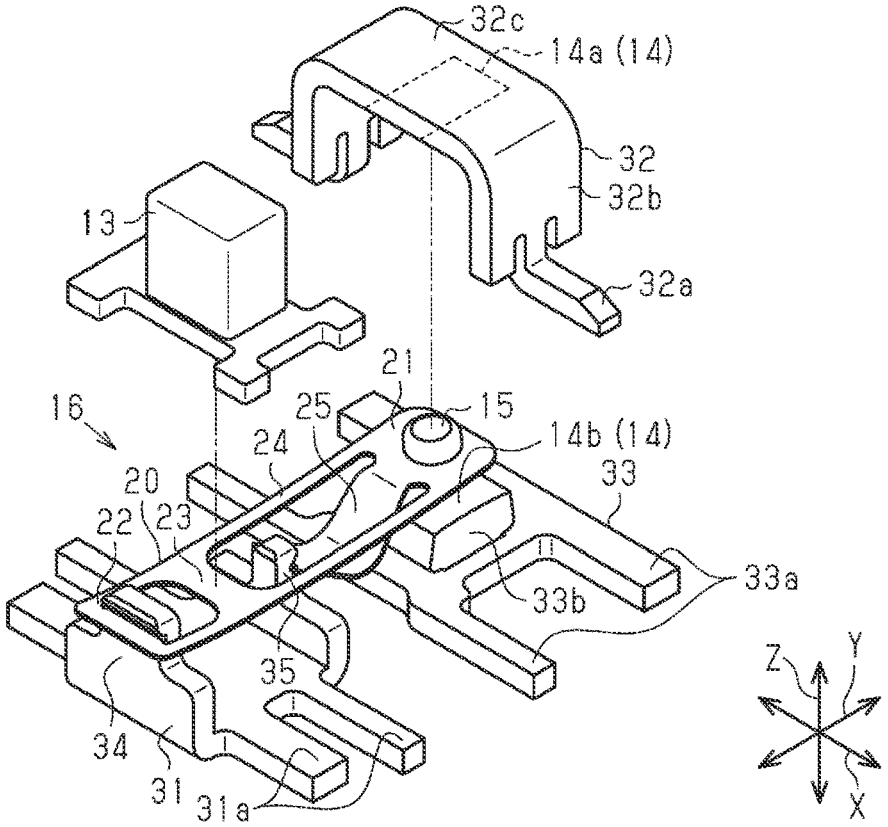
FIG. 3 is an exploded perspective view showing the contact unit.
Figure 4:
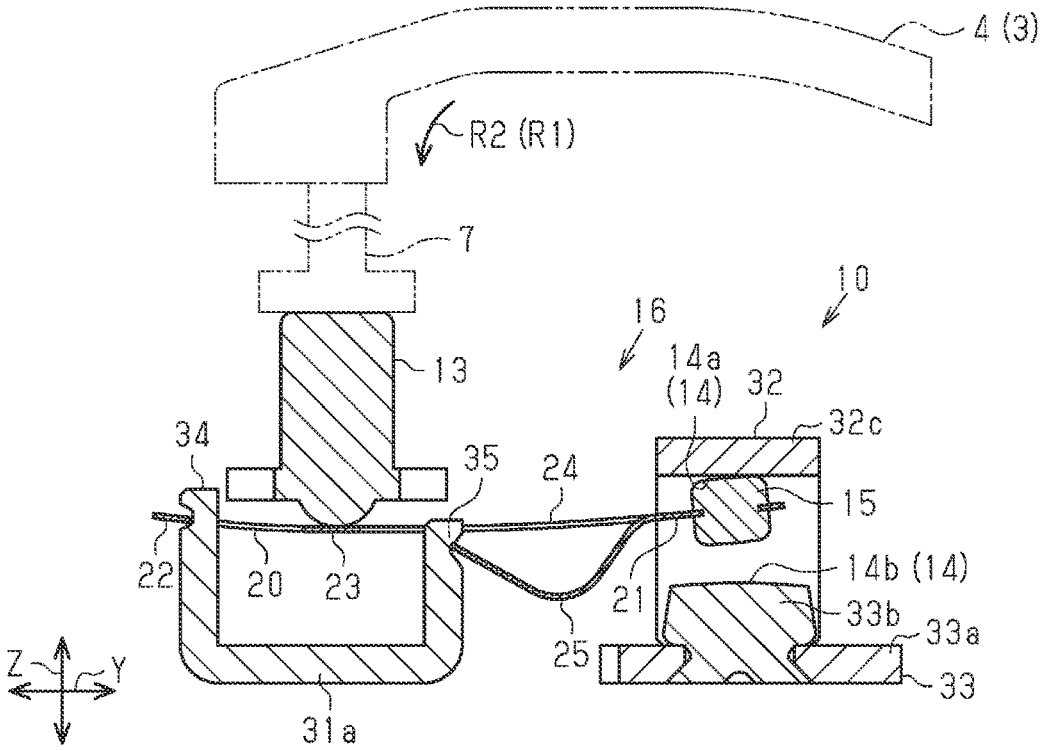
FIG. 4 is a cross-sectional view showing the contact unit.

As shown in FIGS. 3 and 4, the contact unit 10 includes two fixed contacts 14 and a movable contact 15 moved between the fixed contacts 14. The position of the movable contact 15 changes when the operation unit 3 is operated. The movable contact 15 selectively contacts one of the two fixed contacts 14. In other words, the operation unit 3 is operated so that the movable contact 15 moves between two positions and selectively contacts one of the two fixed contacts 14. The two fixed contacts 14 are opposed to each other. The movable contact 15 is arranged between the two fixed contacts 14. In this manner, the two fixed contacts 14 and the movable contact 15 form opposing contacts. In one example, the movable contact 15 is configured to move between a first position where the movable contact 15 contacts one of the two fixed contacts 14 and a second position where the movable contact 15 contacts the other one of the two fixed contacts 14 so that the movable contact 15 selectively contacts one of the two fixed contacts 14.

The contact unit 10 includes a snap action mechanism 16 that switches the contact state of the movable contact 15 and the fixed contacts 14. That is, the snap action mechanism 16 switches the contact state of the movable contact 15 and the fixed contacts 14 between a number of states. In the present embodiment, the snap action mechanism 16 switches the contact state of the movable contact 15 and the fixed contacts 14 between a first state in which the movable contact 15 contacts a first fixed contact 14*a* and a second state in which the movable contact 15 contacts a second fixed contact 14*b*. The snap action mechanism 16 includes a flexible portion 20 on which the movable contact 15 is arranged and a spring portion 25 that is deformed based on an operation amount of the operation unit 3. The deforming force of the spring portion 25 changes the position of the flexible portion 20. In the present embodiment, the flexible portion 20 and the spring portion 25 are integrated to form a leaf spring.

The contact unit 10 includes a first terminal 31 connected to the movable contact 15, a second terminal 32 connected to one of the two fixed contacts 14 (hereafter referred to as the first fixed contact 14*a*), and a third terminal 33 connected to the other one of the two fixed contacts 14 (hereafter referred to as the second fixed contact 14*b*). The first terminal 31 corresponds to a "movable terminal." The second terminal 32 and the third terminal 33 correspond to "fixed terminals."

The flexible portion 20 extends in the device length direction inside the case 12. The flexible portion 20 includes a first end 21 where the movable contact 15 is arranged, a second end 22 engaged with the first terminal 31, and a pushed part 23 pushed by the push unit 13. The pushed part 23 is located between the first end 21 and the second end 22 in the device length direction. The flexible portion 20 also includes arm portions 24 that are spaced apart from each other in the device width direction and extended in the device length direction. The arm portions 24 connect the first end 21, the second end 22, and the pushed part 23.

The spring portion 25 is bent. The spring portion 25 has one side connected to the first end 21 of the flexible portion 20 and an opposite side supported by the first terminal 31. The spring portion 25 is compressed and supported by the first terminal 31. The elastic force of the spring portion 25 urges the first end 21 of the flexible portion 20 toward the first fixed contact 14*a*.

The first terminal 31 includes an engaging portion 34 that is engaged with the flexible portion 20 and a support portion 35 that supports the spring portion 25. The engaging portion 34 includes, for example, a groove that receives the second end 22 for engagement with the flexible portion 20. The second end 22 is pivotal about the engaging portion 34. The support portion 35 is located between the movable contact 15 and the engaging portion 34 in the device length direction. The spring portion 25 is inserted into and engaged with, for example, a groove of the support portion 35. The spring portion 25 is pivotal about the support portion 35. The pushed part 23 of the flexible portion 20 is located between the engaging portion 34 and the support portion 35 in the device length direction.

In a state in which the operation unit 3 is not operated, the spring portion 25 holds the movable contact 15 in contact with the first fixed contact 14*a* (refer to FIG. 4). The operation unit 3 is operated by a certain amount to deform the spring portion 25 and change the position of the flexible portion 20. This switches the movable contact 15 from a state contacting the first fixed contact 14*a* to a state contacting the second fixed contact 14*b*.

The first terminal 31, the second terminal 32, and the third terminal 33 respectively include first mounting portions 31*a*, second mounting portions 32*a*, and third mounting portions 33*a* that are attached to the board 11. The first mounting portions 31*a*, the second mounting portions 32*a*, and the third mounting portions 33*a* are each laid out across the board 11.

As shown in FIG. 2, the first mounting portions 31*a*, the second mounting portions 32*a*, and the third mounting portions 33*a* extend out of the case 12 on the board 11. The parts of the first mounting portions 31*a*, the second mounting portions 32*a*, and the third mounting portions 33*a* extending out of the case 12 are, for example, soldered and attached to the board 11. In the present embodiment, the first mounting portions 31*a*, the second mounting portions 32*a*, and the third mounting portions 33*a* are attached to the board 11 at different locations. This mounts the contact unit 10 on the surface of the board 11. The board 11 includes first connection terminals 11*a*, second connection terminals 11*b*, and third connection terminals 11*c* that are where the circuit of the board 11 is connected to the first mounting portions 31*a*, the second mounting portions 32*a*, and the third mounting portions 33*a*.

As shown in FIGS. 3 and 4, the engaging portion 34, the support portion 35, and the first mounting portions 31*a* of the first terminal 31 are formed integrally from a conductive material. The engaging portion 34 and the support portion 35 are electrically connected to the movable contact 15 by the flexible portion 20 and the spring portion 25. The movable contact 15 is electrically connected to the board 11 by the first terminal 31.

The second terminal 32 includes leg portions 32*b* extending upward from the second mounting portions 32*a* and an opposed portion 32*c* arranged on the upper ends of the leg portions 32*b* and opposed toward the third terminal 33. The second mounting portions 32*a*, the leg portions 32*b*, and the opposed portion 32*c* of the second terminal 32 are formed integrally from a conductive material. In the present embodiment, the two leg portions 32*b* are arranged to sandwich the opposed portion 32*c*. In the present embodiment, the two leg portions 32*b* extend upward from two portions of the second mounting portions 32*a*. The first fixed contact 14*a* is arranged on the lower surface of the opposed portion 32*c*. The first fixed contact 14*a* is electrically connected to the board 11 by the second terminal 32.

The third terminal 33 includes a platform 33*b* projecting upward from the third mounting portions 33*a*. The platform 33*b* is conductive and electrically connected to the board 11 by the third mounting portions 33*a*. The platform 33*b* may be directly connected to the lower surface of the board 11. The platform 33*b* is opposed toward the opposed portion 32*c* of the second terminal 32. The second fixed contact 14*b* is arranged on the upper surface of the platform 33*b*. The second fixed contact 14*b* is electrically connected to the board 11 by the third terminal 33.

Figures 5, 6:
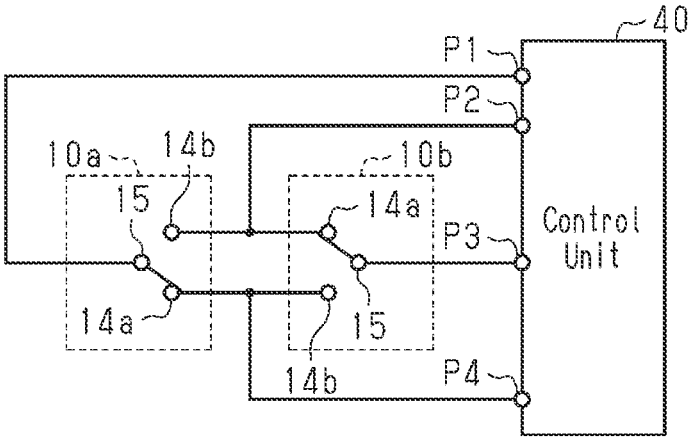
FIG. 5 is a schematic diagram of a circuit and a control unit on a board.
FIG. 6 is a diagram showing the connection states of ports that correspond to positions of an operation unit.

As shown in FIG. 5, the switch device 1 includes a control unit 40 that controls the activation of the parking brake of the vehicle based on the contact states of the contact unit 10. The control unit 40 includes ports P1 to P4 that are connected to the contact unit 10 by the circuit on the board 11.

In the present embodiment, the switch device 1 includes two contact units 10. The two contact units 10 are arranged in the operation unit 3 at a side in the first operation direction R1 and a side in the second operation direction R2. That is, a set of the movable contact 15, the first fixed contact 14*a*, and the second fixed contact 14*b* is arranged in the operation unit 3 at the side in the first operation direction R1, and another set of the movable contact 15, the first fixed contact 14*a*, and the second fixed contact 14*b* is arranged in the operation unit 3 at the side in the second operation direction R2.

The contact unit 10 at the side in the first operation direction R1 is referred to as the first contact unit 10*a*, and the contact unit 10 at the side in the second operation direction R2 is referred to as the second contact unit 10*b*. The switch device 1 includes two pushers 7 that correspond to the two contact units 10. The first contact unit 10*a* and the second contact unit 10*b* perform similar actions in different directions. The contact state of the first contact unit 10*a* is switched when the spring portion 25 is deformed by, for example, operation of the operation unit 3 to the first operation position. The contact state of the second contact unit 10*b* is switched when the spring portion 25 is deformed by, for example, operation of the operation unit 3 to the second operation position.

In the control unit 40, port P1 is connected to the movable contact 15 of the first contact unit 10*a*. Port P2 is connected to the second fixed contact 14*b* of the first contact unit 10*a* and the first fixed contact 14*a* of the second contact unit 10*b*. Port P3 is connected to the movable contact 15 of the second contact unit 10*b*. Port P4 is connected to the first fixed contact 14*a* of the first contact unit 10*a* and the second fixed contact 14*b* of the second contact unit 10*b*.

As shown in FIG. 6, when the position of the operation unit 3 changes, the contact state changes. This changes the connection state of ports P1 to P4, which output detection signals to the control unit 40. When the operation unit 3 is arranged at the initial position, port P1 and port P4 are connected. Further, port P2 and port P3 are connected (state shown in FIG. 5). When the operation unit 3 is arranged at the first operation position, port P1, port P2, and port P3 are connected. When the operation unit 3 is arranged at the second operation position, port P1, port P3, and port P4 are connected.

The control unit 40 detects the connection state of ports P1 to P4 and determines the operation state of the operation unit 3 based on the detected connection state. The control unit 40 continuously determines the operation state in predetermined cycles. The control unit 40 controls activation and deactivated of the electric parking brake based on the determined operation state of the operation unit 3. The control unit 40 has a diagnostic functionality and refers to the connection state of the ports P1 to P4 to diagnose the switch device 1 and find faults such as wire breakage in the circuit. The control unit 40 carries out a diagnosis, for example, whenever determining an operation state. The control unit 40 continuously implements the diagnostic functionality. The speed at which the snap action mechanism 16 in the present embodiment switches the contact state is set so that the time required to switch the contact state is shorter than the determination cycle of the control unit 40.

The operation of the present embodiment will now be described.

Figure 7A:
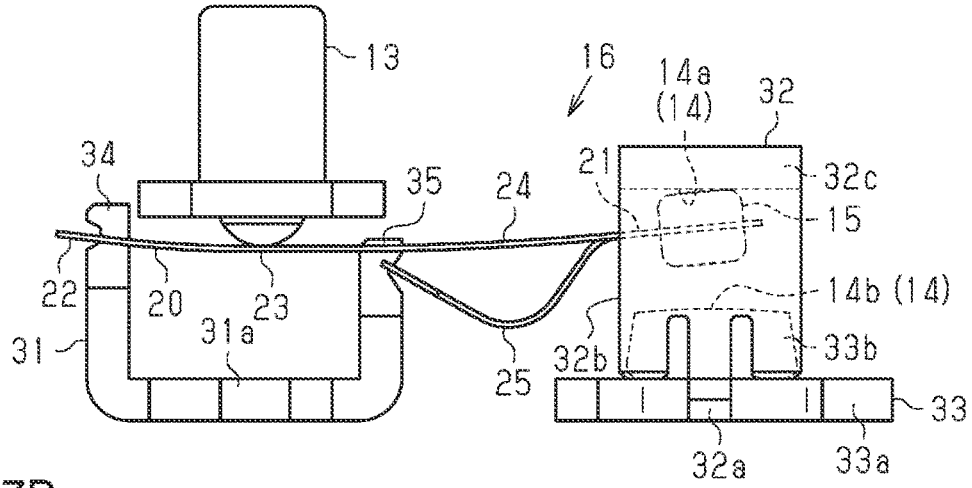
FIG. 7A is an operation diagram of a snap action mechanism.

As shown in FIG. 7A, when the operation unit 3 is arranged at the initial position before being operated, that is, in a state in which the operation unit 3 is not operated, the elastic force of the spring portion 25 urges the first end 21 of the flexible portion 20 upward. This holds the movable contact 15 in contact with the first fixed contact 14*a*. At the initial position, when the operation unit 3 is operated, the pusher 7 depresses and moves the push unit 13 downward. The push unit 13 then pushes the pushed part 23 downward.

Figure 7B:
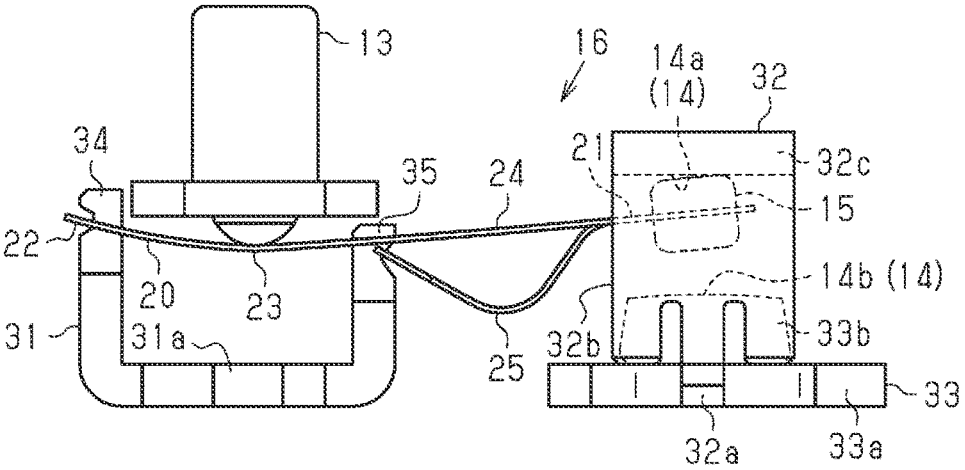
FIG. 7B is an operation diagram of a snap action mechanism.

As shown in FIG. 7B, when the operation unit 3 is operated from the initial position and moved to an intermediate position during the operation before reaching the first operation position or the second operation position, the pushed part 23 of the flexible portion 20 is pushed by the push unit 13. This pivots the flexible portion 20 downward about the second end 22, whereas the first end portion 21 of the flexible portion 20 is held at an upward position by the urging force of the spring portion 25. In this state, the arm portions 24 of the flexible portion 20 are elastically deformed and flexed to allow the pushed part 23 to move downward. Accordingly, when the operation unit 3 is operated and arranged at an intermediate position, the movable contact 15 is held in contact with the first fixed contact 14*a*.

Figure 7C:
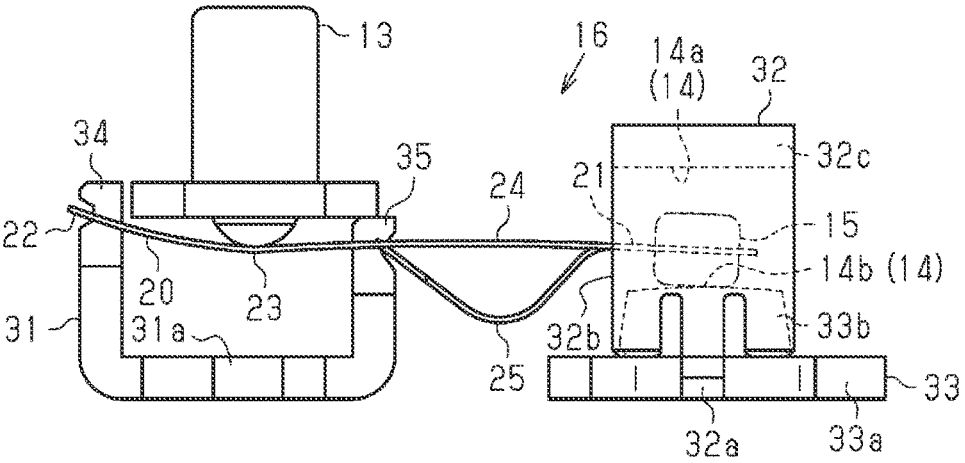
FIG. 7C is an operation diagram of a snap action mechanism.

As shown in FIG. 7C, when the operation unit 3 is further operated to the first operation position or the second operation position, the movable contact 15 is further pivoted downward about the second end 22. This deforms and pivots the spring portion 25 downward about the support portion 35. In this state, the arm portions 24 of the flexible portion 20 are elastically deformed to invert the flection direction and instantaneously move the first end 21 of the flexible portion 20 downward. The movable contact 15 is instantaneously switched from a state contacting the first fixed contact 14*a* to a state contacting the second fixed contact 14*b*. In this manner, the snap action mechanism 16 deforms the spring portion 25 in accordance with the operation amount of the operation unit 3 to instantaneously switch the contact state regardless of the speed or force with which the operation unit 3 is operated.

When the user releases the operation unit 3, the spring portion 25 is re-deformed to instantaneously move the first end 21 upward. The movable contact 15 returns to the state in which it contacts the first fixed contact 14*a*. The flexible portion 20 lifts the push unit 13. Thus, the flexible portion 20 returns to the initial position where it was located before being operated (state of FIG. 7A).

The control unit 40 determines the operation state of the operation unit 3 from the connection state of port P1, port P2, port P3, and port P4. The control unit 40 continuously determines the operation state in predetermined determination cycles. When the control unit 40 detects operation of the operation unit 3 from the initial position to the first operation position, the control unit 40 executes control to, for example, activate the parking brake. When the control unit 40 detects operation of the operation unit 3 from the initial position to the second operation position, the control unit 40 executes control, for example, deactivate the parking brake. When the operation unit 3 is returned from the first operation position or the second operation position to the initial position, the control unit 40 maintains the current activation state of the parking brake.

The diagnostic functionality of the control unit 40 diagnoses the switch device 2 to find a fault such as wire breakage in the circuit. For example, when a wire breakage or a contact failure occurs in the circuit, such a fault can be determined from a connection interruption at any one of the ports P1 to P4. The diagnosis is performed whenever an operation state is determined. In the present embodiment, the determination cycle of the control unit 40 is longer than the time required to switch the contact state with the snap action mechanism 16.

As described above, the snap action mechanism 16 switches the contact state of the movable contact 15 in accordance with the operation amount of the operation unit 3. Even if the operation unit 3 is held at an intermediate position while being operated, the movable contact 15 will be held in contact with the first fixed contact 14*a*. That is, the contact state of the movable contact 15 is switched regardless of speed or force with which the operation unit 3 is operated. Thus, the movable contact 15 does not remain separated from the first fixed contact 14*a* or the second fixed contact 14*b*. This avoids erroneous fault detection.

The snap action mechanism 16 deforms the spring portion 25 to switch the contact state. This increases the speed at which the contact states are switched. In the present embodiment, the time required to switch the contact state with the snap action mechanism 16 is shorter than the determination cycle of the control unit 40. This avoids erroneous fault detection during the switching.

The two fixed contacts 14 and the movable contact 15 are opposed toward each other. If a sliding contact were to be used, the surfaces of contact between the movable contact 15 and the fixed contacts 14 will affect the stroke of the movable contact 15. In contrast, when the contacts are opposed to each other, the stroke of the movable contact 15 will not be affected by the size or the shape of the movable contact 15. This shortens the stroke of the movable contact 15 as compared with a sliding contact. The shorter stroke reduces a noise of an action generated when the contact state is switched.

The advantages of the present embodiment will now be described.

(1) The switch device 1 includes the two fixed contacts 14 and the movable contact 15. The position of the movable contact 15 is changed when the operation unit 3 is operated so that the movable contact 15 selectively contacts the fixed contacts 14. The switch device 1 includes the snap action mechanism 16 that deforms the spring portion 25 in accordance with the operation amount of the operation unit 3 to switch the contact state of the movable contact 15 with the fixed contacts 14. The switch device 1 further includes the control unit 40 that determines the operation state of the operation unit 3 based on the detection signal received from the fixed contacts 14 and the movable contact 15. With this structure, the snap action mechanism 16 switches the contact state of the movable contact 15 in accordance with the operation amount of the operation unit 3. Even if the operation unit 3 is held at an intermediate position while being operated, the movable contact 15 will be held in contact with the first fixed contact 14*a*. That is, the contact state of the movable contact 15 is switched regardless of speed or force with which the operation unit 3 is operated. Thus, the movable contact 15 does not remain separated from the first fixed contact 14*a* or the second fixed contact 14*b*. This avoids erroneous fault detection.

(2) The snap action mechanism 16 includes the spring portion 25 and the flexible portion 20 attached to the movable contact 15. The deforming force of the spring portion 25 changes the position of the flexible portion 20. With this structure, the spring portion 25 is deformed to move the flexible portion 20 and quickly switch the contact state.

(3) The spring portion 25 and the flexible portion 20 are integrated to form a leaf spring. With this structure, the contact state is quickly switched with less components.

(4) The switch device 1 includes the first terminal 31 that electrically connects the movable contact 15 and the control unit 40. The first terminal 31 includes the engaging portion 34 that engages the second end 22 of the flexible portion 20 at the side of the flexible portion 20 opposite to the first end 21 where the movable contact 15 is arranged. With this structure, the first terminal 31 electrically connects the movable contact 15 and the control unit 40 and supports the flexible portion 20. This reduces the number of components.

(5) The spring portion 25 is bent, compressed, and supported by the first terminal 31. With this structure, the single first terminal 31 supports both of the flexible portion 20 and the spring portion 25 and reduces the number of components. The first terminal 31 is electrically connected to the movable contact 15 by the flexible portion 20 and the spring portion 25. This stabilizes the electrical connection of the movable contact 15 and the control unit 40.

(6) The movable contact 15 is opposed to the two fixed contacts 14. With this structure, the stroke of the movable contact 15 is shorter than a sliding contact. The short stroke reduces noise of an action generated when the contact state is switched.

(7) The switch device 1 includes the case 12 accommodating the fixed contacts 14 and the movable contact 15, the first terminal 31 electrically connected to the movable contact 15, and the second terminal 32 and the third terminal 33 electrically connected to the fixed contacts 14. The first terminal 31, the second terminal 32, and the third terminal 33 respectively include the first mounting portions 31*a*, the second mounting portions 32*a*, and the third mounting portions 33*a* attached to the board 11. The first mounting portions 31*a*, the second mounting portions 32*a*, and the third mounting portions 33*a* extend out of the case 12 on the mounting surface of the board 11. With this structure, the contact unit 10 is mounted on the surface of the board 11. This allows for easy mounting.

(8) The speed at which the snap action mechanism 16 switches the contact state is set so that the time required to switch the contact state is shorter than the determination cycle of the control unit 40. This structure avoids erroneous fault detection during the switching of the contact state.

The present embodiment may be modified as follows. The present embodiment and the following modifications can be combined as long as the combined modifications are not in contradiction.

With regard to the speed at which the snap action mechanism 16 switches the contact state, the time required to switch the contact state may be shorter than, equal to, or longer than the determination cycle of the control unit 40.

The contact unit 10 does not need to be mounted on the surface of the board 11. The first mounting portions 31*a*, the second mounting portions 32*a*, and the third mounting portions 33*a* may be inserted into holes of the board 11.

The circuit of the board 11 does not have to be connected to the first terminal 31, the second terminal 32, and the third terminal 33 as illustrated in the present embodiment. That is, the arrangement, size, and shape of the first connection terminals 11*a*, the second connection terminals 11*b*, and the third connection terminals 11*c* are not limited in particular.

The fixed contacts 14 and the movable contact 15 may be opposed contacts or sliding contacts.

The spring portion 25 does not need to be supported by the first terminal 31. That is, the support portion 35 may be separate from the first terminal 31.

The flexible portion 20 does not need to be engaged with the first terminal 31. That is, the engaging portion 34 may be separate from the first terminal 31. The movable contact 15 does not need to be electrically connected to the first terminal 31 via the engaging portion 34, which is engaged with the flexible portion 20. The flexible portion 20 may be, for example, a wire that allows for electrical connection with the movable contact 15.

The spring portion 25 and the flexible portion 20 are not limited to the shapes illustrated in the present embodiment.

The spring portion 25 is not limited to the bending direction illustrated in the present embodiment. That is, the spring portion 25 may be bent upward or downward.

When the operation unit 3 is not operated, the spring portion 25 may hold the movable contact 15 in a state contacting the second fixed contact 14*b*. Further, the spring portion 25 may switch the movable contact 15 to a state contact with the first fixed contact 14*a* in accordance with the operation amount of the operation unit 3.

The spring portion 25 and the flexible portion 20 may be separate.

The spring portion 25 does not need to be formed by a leaf spring.

The flexible portion 20 does not need to be formed by a leaf spring.

The control unit 40 may be arranged on the board 11 and may be arranged outside the frame 2.

The contact unit 10 does not need to be operated by the pusher 7. Instead, the contact unit 10 may be directly operated.

The operation unit 3 does not need to be of a momentary type.

The operation unit 3 may be operated in any manner. The two ends of the operation unit 3 may be pushed to tilt in two directions or perform a sliding action.

The operation unit 3 may be shaped in any manner. The display 6 may be omitted.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A switch device operated to switch an activation state of a parking brake for a vehicle, the switch device comprising:

a first contact unit and a second contact unit, each of the first contact unit and the second contact unit including:
- a first fixed contact;
- a second fixed contact;
- a movable contact of which position is changed when an operation unit is operated to selectively contact the first fixed contact and second fixed contact; and
- a snap action mechanism that switches a contact state of the movable contact with the first and second fixed contacts by deforming a spring portion in accordance with an operation amount of the operation unit; and a control unit including:
- a first port that is connected to the movable contact of the first contact unit;
- a second port that is connected to the second fixed contact of the first contact unit and the first fixed contact of the second contact unit;
- a third port that is connected to the movable contact of the second contact unit; and
- a fourth port that is connected to the first fixed contact of the first contact unit and the second fixed contact of the second contact unit, wherein the control unit is configured to detect a connection state of the first to fourth ports, determine an operation state of the operation unit based on the detected connection state, and switch the activation state of the parking brake based on the determined operation state of the operation unit.

2. The switch device according to claim 1, wherein the snap action mechanism includes:

the spring portion; and a flexible portion attached to the movable contact, wherein a position of the flexible portion is changed by a deforming force of the spring portion.

3. The switch device according to claim 2, wherein the spring portion and the flexible portion are integrated to form a leaf spring.

4. The switch device according to claim 2, wherein each of the first contact unit and the second contact unit further includes:

a movable terminal that electrically connects the movable contact and the control unit, wherein the flexible portion includes a first end on which the movable contact is arranged and a second end located at a side opposite to the first end, and the movable terminal includes an engaging portion that engages the second end of the flexible portion.

5. The switch device according to claim 4, wherein the spring portion is bent, compressed, and supported by the movable terminal.

6. The switch device according to claim 1, wherein the movable contact is opposed to the first and second fixed contacts.

7. The switch device according to claim 1, wherein each of the first contact unit and the second contact unit further includes:

a case that accommodates the first and second fixed contacts and the movable contact;

a fixed terminal electrically connected to the first and second fixed contacts; and a movable terminal electrically connected to the movable contact, wherein the fixed terminal and the movable terminal each include a mounting portion attached to a board that includes a mounting surface so that the mounting portion extends out of the case on the mounting surface.

8. The switch device according to claim 1, wherein a speed at which the snap action mechanism switches the contact state is set so that time required to switch the contact state is shorter than a determination cycle of the control unit.

* * * * *